United States Patent [19]

Kalina et al.

[11] Patent Number: 4,967,803

[45] Date of Patent: Nov. 6, 1990

[54] DEFECTIVE WEFT REMOVAL WITH UNSEPARATED WEFT LENGTHS

[75] Inventors: Jan Pajgrt, Brno; Vincenc Smetak, Lelekovice; Jaroslav Kalina; Michal Zemek both of Brno; Milan Pus, Uhersk Brod; Pavel Bucek; Jirí Vystrcil, both of Brno, all of Czechoslovakia

[73] Assignee: ZVS-Výzkumnevývojový ûstav koncernová ûcelová organizace, Brno, Czechoslovakia

[21] Appl. No.: 315,625

[22] Filed: Feb. 24, 1989

[30] Foreign Application Priority Data

Feb. 25, 1988 [CS] Czechoslovakia ..... 1214-88

[51] Int. Cl.[5] ..... D03D 47/30

[52] U.S. Cl. ..... 139/116.2

[58] Field of Search ..... 139/116.2

[56] References Cited

U.S. PATENT DOCUMENTS 4,688,606 8/1987 Tamatani ..... 138/116 A 4,781,221 11/1988 Onishi et al. ..... 139/116 A

FOREIGN PATENT DOCUMENTS 0207470 7/1987 European Pat. Off. .

*Primary Examiner*—Andrew M. Falik

*Attorney, Agent, or Firm*—Klein & Vibber

[57] ABSTRACT

Method of preparing a weft and its removal from an open shed in jet weaving machines automates the preparatory operation of weft upon finding a weaving fault. This is achieved by performing both the preparation and the withdrawal of the weft in the course of the first quadrant of the jet weaving machine revolution. The method includes the step of supplying a further unseparated weft length, forming a loop between the unseparated weft length in the open shed while the loop elongates due to the action of an inserting medium until the loop face emerges from the shed on the shed outlet side and removing the weft from the shed by a weft withdrawing device.

1 Claim, 3 Drawing Sheets

DEFECTIVE WEFT REMOVAL WITH UNSEPARATED WEFT LENGTHS

FIELD OF THE INVENTION

The present invention relates to a method of preparing the weft and its removal from the open shed in jet weaving machines upon determining a weaving fault.

BACKGROUND OF THE INVENTION

A method of preparing the weft and its removal from the shed of warp threads is known. Upon stoppage of the weaving machine and its taking up of the open shed position with the faulty weft, a clamp is extended towards its free end by a combined motion performed by a pair of pneumatic cylinders. The free end of the weft is gripped by the clamp and, thereupon, a flexible belt is slipped out from a box, fixed in front of the shed on the beam of a shaped reed. At the end of the belt, a vane with bent sides is mounted, which is inserted into the shed below the clamp. One side of the vane is guided along the beam, and by the other bent side, the weft held by the clamp is entrapped.

By the motion through the shed along the shaped reed, the entrapped faulty weft, which is entrapped by the other side of the vane, is mechanically disengaged from the interlacing point. Upon passing through the whole shed length, the vane is shifted back to the box by winding back the flexible belt. Thereupon, the clamp presents the clamped end of the disengaged faulty weft to the suction nozzle, which removes it by sucking it off the shed. Upon termination of this unweaving cycle, it is possible to restart the weaving cycle on the machine.

A disadvantage of this known method of weft preparation and its removal from the shed lies in its extraordinary demand for numerous and exact sequential disengaging motions. This mechanical weft disengagement is neither careful nor reliable, as the weft to be disengaged can break when the vane contacts an uneveness of the weft fiber or when the weft is otherwise pulled beyond its stress limit. In such a case, neither the preparation, nor the removal of the weft can be finished.

Another known method is disclosed in U.S. Pat. No. 4,781,221, the complete disclosure of which is incorporated herein by reference. In the '221 patent, a mispicked weft is removed from fabric by stopping the loom with the mispicked weft still connected to the inserter, after having been beaten up by the reed. The mispicked weft is then exposed at the fell, specifically by loom reversal. Another weft connected to the mispicked weft is then inserted from picking side to arrival side, from which side both wefts are withdrawn.

The advantages of the '221 patent are that no mechanical weft extractor is used, so there is no risk of damaging the warps and the mispicked weft is effectively peeled from the fabric fell. It has been discovered, however, that a significant improvement in this method is attainable if the preparation of the weft and its removal are performed within the course of the first revolution quadrant of the weaving machine.

SUMMARY OF THE INVENTION

The method according to the present invention provides that preparation of the weft and its removal are performed within the course of the first revolution quadrant of the weaving machine.

Advantages of the method according to the present invention include its reliability and its efficiency upon considerate treatment of warp threads and the weft. A further substantial advantage of the method is its applicability in all types of jet weaving machines.

BRIEF DESCRIPTION OF THE DRAWING

An exemplary performing of the method of preparing the weft and its removal according to the present invention is diagrammatically represented in the accompanying drawings, of which FIGS. 1–3 demonstrate, in phases, the method of forming a long loop upon application of a pressure medium as insertion means.

DESCRIPTION OF THE PREFERRED EMBODIMENT

During the weaving process in a known weaving machine, the insertion of weft 1 across shed 2 of warp threads 3 is tracked and checked by weft stop motion 4 at the exit side of shed 2.

Figure 1:
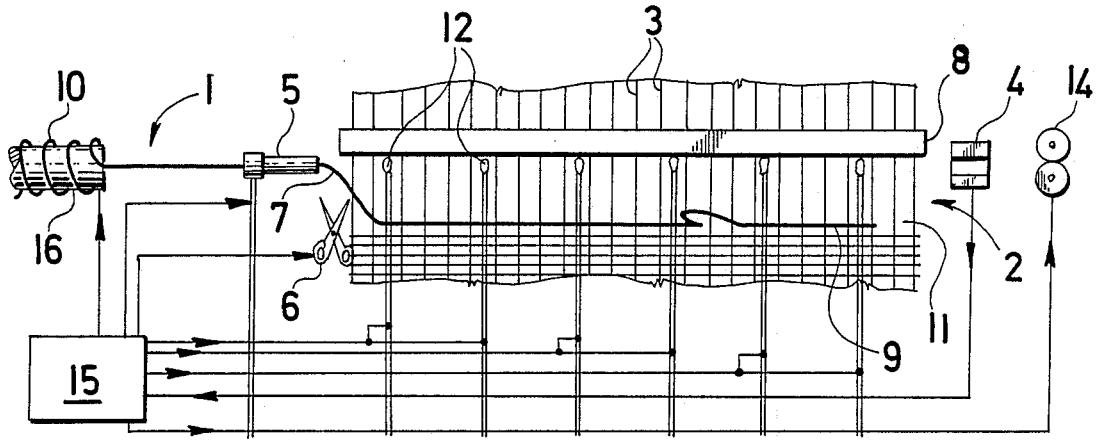
Figure 2:
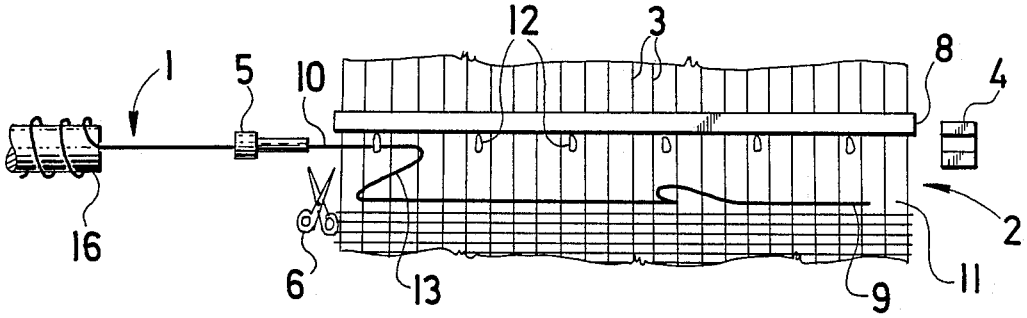
Figure 3:
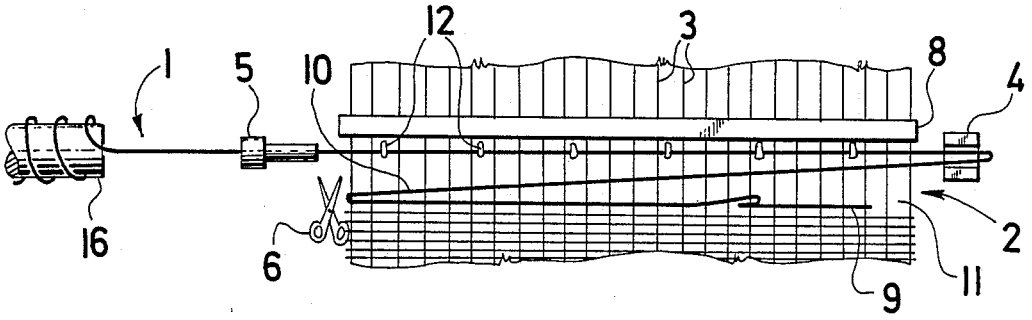

Upon performing the method as shown in FIGS. 1–3, weft stop motion 4 emits, on determining short pick of weft 1 towards the end of shed 2, a signal to a control device 15, which thereupon stops the length measurement of weft 1 by measuring device 16, together with simultaneous prevention of the inlet of the pressure medium, forming the inserting means, into the inserting nozzle 5. By measuring the length of weft 1, a controlled regulation of its tensile stress upon weaving is performed. Simultaneously with the signal for weaving stoppage, a signal for blocking cutter 6 is emitted, for the purpose of preventing separation of weft 1 at the inlet side of shed 2 (FIG. 1). In the course of the stoppage of the weaving process, renewed measuring maintains constant tension stress in free part 7 of the length of weft 1, for the purpose of preventing break-off of the mispicked length 9 of weft 1 form the free part 7 of its length upon beat-up.

Upon stoppage of the weaving process, the weaving machine is reversed into the shed 2 with the mispicked length 9 of weft 1. For the purpose of preventing any increase of tensile stress in the free part 7 of weft 1, e.g. at least a part of the measured following weft length 10 is released, which is thereupon, as required, withdrawn. The reversing of the weaving machine run is stopped in a position in which, during the normal weaving process, the insertion of weft 1 is started. This is advantageous because in this still first quadrant of the weaving machine revolution, the motion of warp threads 3 precedes that of the reed 8 with the inserting channel, moving away from interlacing point 11. The consequence thereof is that the shed 2 of warp threads 3 is considerably opened, reed 8 is not excessively remote from interlacing point 11, and the auxiliary nozzles 12 project into shed 2, via the lower branch of warp threads 3, only by their upper parts with exit openings.

When the shed 2 opens in the position where there the mispicked length 9 of weft 1 is, the pressure fluid begins to flow through the inserting nozzle 5 and starts acting thereupon. By action of the pressure medium flow traction, the released measured following length 10 of weft 1 begins to be withdrawn, while being continuously completed in its length. By action of the pressure medium flow in the main nozzle 5 and subsequently also in the auxiliary nozzles 12, weft 1 is withdrawn from the completed measured length 10 and forms a loop 13 in the shed 2 (FIG. 2), which continuously extends, until its front part appears at the exit side of shed 2, where its presence is identified by weft stop motion 4 (FIG. 3).

Figure 4:
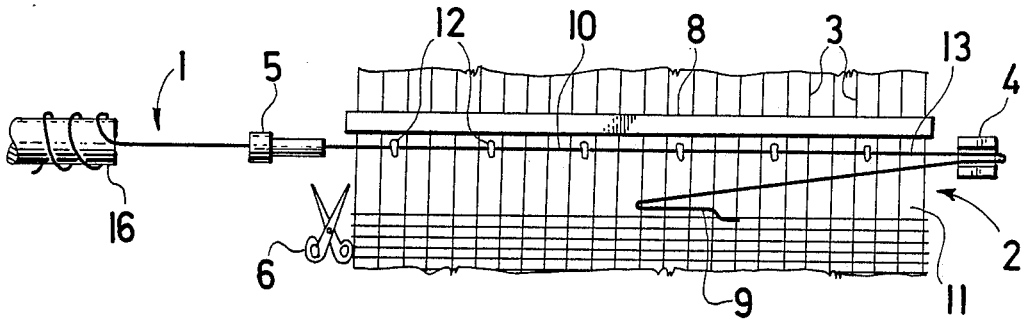
FIGS. 4 and 5, show the final phase of the weft removal from the shed prepared according to FIGS. 1 to 3.

The front of loop 13 of weft 1 is gripped behind the weft stop motion 4 by a withdrawing mechanism 14, and by its action, the loop 13 of weft 1 is withdrawn from shed 2, weft 1 remaining parallely doubled (FIG. 4).

Figure 6:
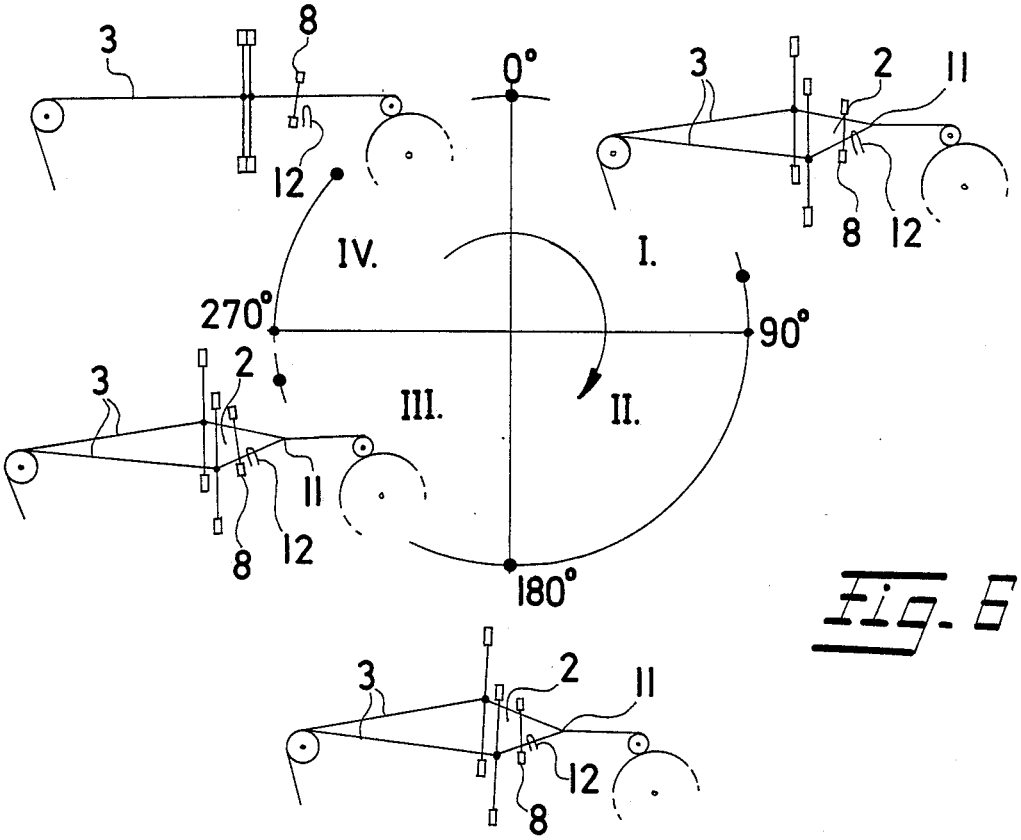
FIG. 6 schematically illustrates with a circle four quadrants of one revolution of a weaving machine and shows individual phases of kinematic motion of the machine, where the illustrated operative positions of the machine correspond to points marked on the circle.

Referring to FIG. 6, at 0 degrees the weaving machine is in the position where reed 8 is in the front dead center, i.e. beaten-up to the fell 11, with the warp threads aligned.

In the first quadrant, as shown in FIG. 6, the motion of warp threads 3 precedes that of the reed 8 with the inserting channel, moving away from interlacing point 11. The consequence thereof is that the shed 2 of warp threads 3 is considerably opened, reed 8 is not excessively remote from interlacing point 11, and the auxiliary nozzles 12 project into shed 2, via the lower branch of warp threads 3, only by their upper parts with exit openings.

At 180 degrees, the shed 2 from warp threads 3 is fully opened, reed 8 is in the rear dead center and there is a maximum protrusion of auxiliary nozzles 12 into the shed 2.

In the third quadrant, the shed 2 is closing and the reed 8 is in its phase of motion towards the fell 11.

In the fourth quadrant, alignment of the warp threads 3 takes place, i.e. a complete closing of the shed 2. Auxiliary nozzles 12 are placed under the warp threads 3 and the reed 8 before beat-up to the fell 11.

Figure 5:
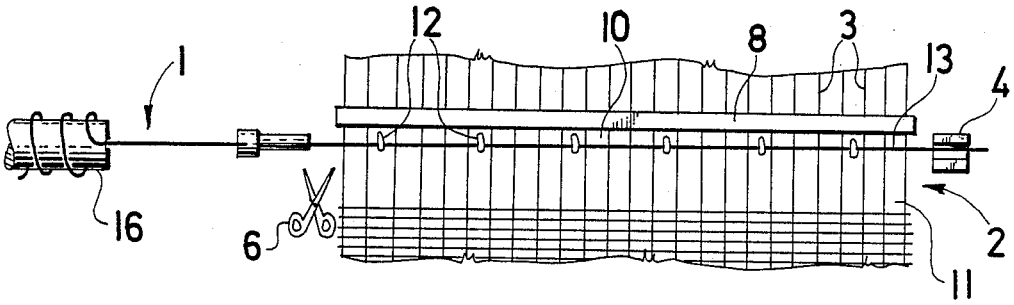

Upon performing the method according to the present invention, two versions of removing the weft 1 are basically feasible in weaving machines:

Either, before withdrawal of the parallely doubled weft 1, loop 13 is separated at the inlet side of shed 2 by cutter 6, or the cutter is blocked further, and the length of weft 1 remains continuous. In that case, simultaneously with the withdrawal of the parallely doubled length of weft 1 from the shed 2 by drawing one length thereof, which is connected by its free part 7 to the measured following length 10, the latter is drawn into the shed 2. By withdrawing the parallely doubled weft 1 from the shed 2, its following single length 10 remains prepared therein (FIG. 5), and the weaving process can be renewed by beating said single length up into the interlacing point 11 of the manufactured fabric.

When a fabric is woven from a material where there is a possibility of formation of a start mark, then before withdrawal of the parallely doubled weft 1, its length, which is connected to the free part 7 it is separated therefrom by cutter 6, e.g. by displacing said length of weft 1 towards the interlacing point 11 into the active area of cutter 6 by reed 8. Upon withdrawing the parallely doubled length of weft 1, the shed 2 thus remains empty, and the normal weaving process is renewed by inserting the following length 10 of weft 1 by nozzle 3, together with the simultaneous starting of the remaining mechanisms of the weaving machine.

This version of the method for preparing weft 1 is advantageously applicable in pneumatic weaving machines with a closed weft inserting channel formed by confusor teeth and a both passive and active method of insertion, also with an open inserting channel formed by profiled dents of the beat-up reed. All functions of measuring the weft 1, its withdrawing into the shed 2 in the form of a loop 13 and its consequent withdrawing from the outlet side of the shed 2, as well as cutting, are controlled by a known control device 15, to the output of which are connected the measuring device 16 of the weft 1, main nozzle 5 and auxiliary nozzles 12. Outlets of the control device 15 are also connected with cutter 6 and with a withdrawing device 14 arranged off the shed 2 behind the weft stop motion 4. The weft stop motion 4 is connected by its outlet with the inlet of the control device 15.

A substantial advantage of the method specified above, in addition to its applicability on many types of weaving machines with either pneumatic, hydraulic, or mechanical insertion of weft 1, is in the constant connection of the mispicked length 9 of weft 1 with its following length 10.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. A method of preparation of a fully woven-in weft for its removal by a weft withdrawing mechanism from an open shed of a jet weaving machine, when the machine stops after the detection of a picking fault in one of the first, second, third or fourth quadrant of the revolution of the machine main shaft, while the weft is inserted into the shed by a flow of an inserting medium flowing through an insertion nozzle in the direction from an inlet side to an outlet side of the shed in unseparated weft lengths with a loop formed between said unseparated lengths, said method comprising:

supplying a further unseparated weft length, forming a loop between said unseparated weft lengths in the open shed while the loop elongates due to the action of an inserting medium until the loop face emerges from the shed on the shed outlet side, removing the weft from the shed by a weft withdrawing device, the preparation and removal of the weft being performed within the course of the first quadrant of the revolution of the jet weaving machine main shaft.

* * * * *